US009266033B2

(12) United States Patent
Davies

(10) Patent No.: US 9,266,033 B2
(45) Date of Patent: Feb. 23, 2016

(54) MOTOR DRIVEN, BUBBLE PRODUCING TOY

(71) Applicant: LITTLE KIDS, INC., Seekonk, MA (US)

(72) Inventor: John T Davies, Blackstone, MA (US)

(73) Assignee: Little Kids, Inc, Seekonk, MA (US)

( * ) Notice: Subject to any disclaimer, the term of this patent is extended or adjusted under 35 U.S.C. 154(b) by 8 days.

(21) Appl. No.: 14/251,852

(22) Filed: Apr. 14, 2014

(65) Prior Publication Data

US 2015/0290551 A1 Oct. 15, 2015

(51) Int. Cl.

| | |
|---|---|
| ***A63H 33/28*** | (2006.01) |
| ***A63H 33/00*** | (2006.01) |
| ***A63H 33/26*** | (2006.01) |

(52) U.S. Cl.

CPC ..... *A63H 33/28* (2013.01); *A63H 33/26* (2013.01)

(58) Field of Classification Search

USPC ..... 446/15–21

See application file for complete search history.

(56) References Cited

U.S. PATENT DOCUMENTS

| | | | | |
|---|---|---|---|---|
| 4,764,141 | A | 8/1988 | D'Andrade | |
| 5,498,191 | A | 3/1996 | DeMars | |
| 5,520,564 | A | 5/1996 | DeMars | |
| 5,613,890 | A | 3/1997 | DeMars | |
| 6,200,184 | B1 | 3/2001 | Rich | |
| 7,056,182 | B2 | 6/2006 | Wan | |
| 7,059,930 | B2 | 6/2006 | Choi | |
| 7,470,165 | B2 | 12/2008 | Ivanic | |
| 8,123,584 | B2 * | 2/2012 | Thai | 446/15 |
| 2002/0094744 | A1 * | 7/2002 | Cheng | 446/15 |
| 2006/0084351 | A1 * | 4/2006 | Wan | 446/15 |
| 2007/0117491 | A1 * | 5/2007 | Thai | 446/15 |
| 2007/0270073 | A1 * | 11/2007 | Thai | 446/15 |
| 2011/0287685 | A1 * | 11/2011 | Lam | 446/15 |

FOREIGN PATENT DOCUMENTS

| | | |
|---|---|---|
| WO | 2008/011346 | 1/2008 |

* cited by examiner

*Primary Examiner* — Nini Legesse

(74) *Attorney, Agent, or Firm* — Chace Ruttenberg & Freedman LLP

(57) ABSTRACT

An improved bubble wand assembly for a motor driven, bubble producing toy is provided. The wand assembly includes a moving substantially semi-circular, wand portion and a stationary, substantially semi-circular, wand portion, the moving and stationary wand portions being hingably connected to each other at the ends thereof to permit the moving wand portion to move in relation to the stationary wand portion from a closed and superposed position over the stationary wand portion to an open, film-forming, position at an angular orientation to the stationary wand portion.

8 Claims, 6 Drawing Sheets

MOTOR DRIVEN, BUBBLE PRODUCING TOY

CROSS-REFERENCE TO RELATED APPLICATIONS

None.

FIELD OF THE INVENTION

The invention is in the field of motor driven, bubble producing toys.

BACKGROUND OF THE INVENTION

Motor driven, bubble producing toys have been around for many years. Typically, such toys have a bubble solution reservoir, a motive power source, for example, a battery, a motor, a pump, a bubble solution feed tube, and a bubble wand. Exemplary patents and patent publications include U.S. Pat. Nos. 4,764,141; 5,613,890; 6,200,184; 7,056,182; 7,059,930, 5,498,191; 5,975,358; 6,663,464; 7,470,165; 5,520,564; 6,024,632; 7,056,182; United States Patent Publication Nos. 2002/0061697; 2002/0090878; 2005/0148276; 2007/0032163; 2012/214378 and PCT Patent Publication No. WO2008/011346.

These bubble producing toys include those in which a bubble ring is dipped into bubble solution and then exposed to an air stream and those in which a wiper, typically a wire, travels across an bubble aperture coating it with bubble solution which is then exposed to an air stream. Both of these mechanisms have drawbacks. In the former case, the dipping ring device tends to lose solution readily or fail to form film consistently so the toy works intermittently. In the latter case, the wire can easily be bent or broken and the toy rendered unusable.

Accordingly, there is a need for an improved bubble producing mechanism that can be used with motor driven bubble producing toys. One such improved mechanism is provided by the invention.

SUMMARY OF THE INVENTION

The invention provides an improved mechanism for producing bubbles in a motor driven bubble producing toy. The mechanism is a bubble generating assembly that automatically forms a bubble film around a bubble wand without the need to dip the bubble wand into the bubble solution reservoir or to wipe the bubble wand with a wiper blade. In the improved mechanism of the invention, a bubble ring, a flat hollow disc that is either dipped in bubble solution or wiped with a wiper to form a film across the hollow portion of the ring is not employed.

The improved mechanism is a bubble wand formed with a moving semi-circular or arcuately shaped, wand portion and a stationary, semi-circular or arcuately shaped, wand portion. The arcuate wand portions are connected to each other by means of a pair of integral hinges located at each of the ends of the semi-circular wands. The pair of hinges permit the moving wand portion to move in relation to the stationary wand portion, from a closed and superposed position over the stationary wand portion to an open, film-forming, position at an angular orientation to the stationary wand portion. The arrangement and orientation of the two wand portions are similar to a jaw, and move in much the same manner. Besides being semi-circular in general shape, the two wand portions may otherwise resemble a typical bubble wand, i.e., with a width that is somewhat greater than the height and with each surface being substantially planer in general aspect.

The opposed surfaces of the moving and stationary wand portions have regularly spaced grooves and ridges or ribs, with the heights of the ribs being consistent throughout, that hold the bubble solution against the wand portion and assist in film formation when the moving wand portion is in it open, film-forming, position as is typical of bubble wands and known in the art. Preferably the wand portions are made of a rigid plastic material and the pair of hinges is formed by means of a pair of integral posts disposed on one of either the moving or stationary wand portions and a pair of post-receiving bores formed in the other wand portion. For example, two integral posts, one at each end, may be formed in the semi-circularly shaped moving wand portion and two bores, one at each end, may be formed in the semi-circularly shaped stationary want portion, or vice versa. Alternatively, the moving wand portion may be formed with one bore and one post and the stationary wand portion may be formed with a mating bore and a mating post. The precise arrangement is not critical. What is critical is that the two wand portions are hinged together at their ends to form a jaw-like structure that can open and close. While the preferred shape of the two wand portions is substantially semi-circular or arcuate, other shapes may also work. For example, a half-ovoid shape or an angled shape such as a half-square or half-rectangle may be employed. Regardless of shape, the two wand portions should be mirror images of each other so as to be superposable.

The invention is exemplified in the following detailed description taken together with the drawings as described below.

DETAILED DESCRIPTION

Figure 1:
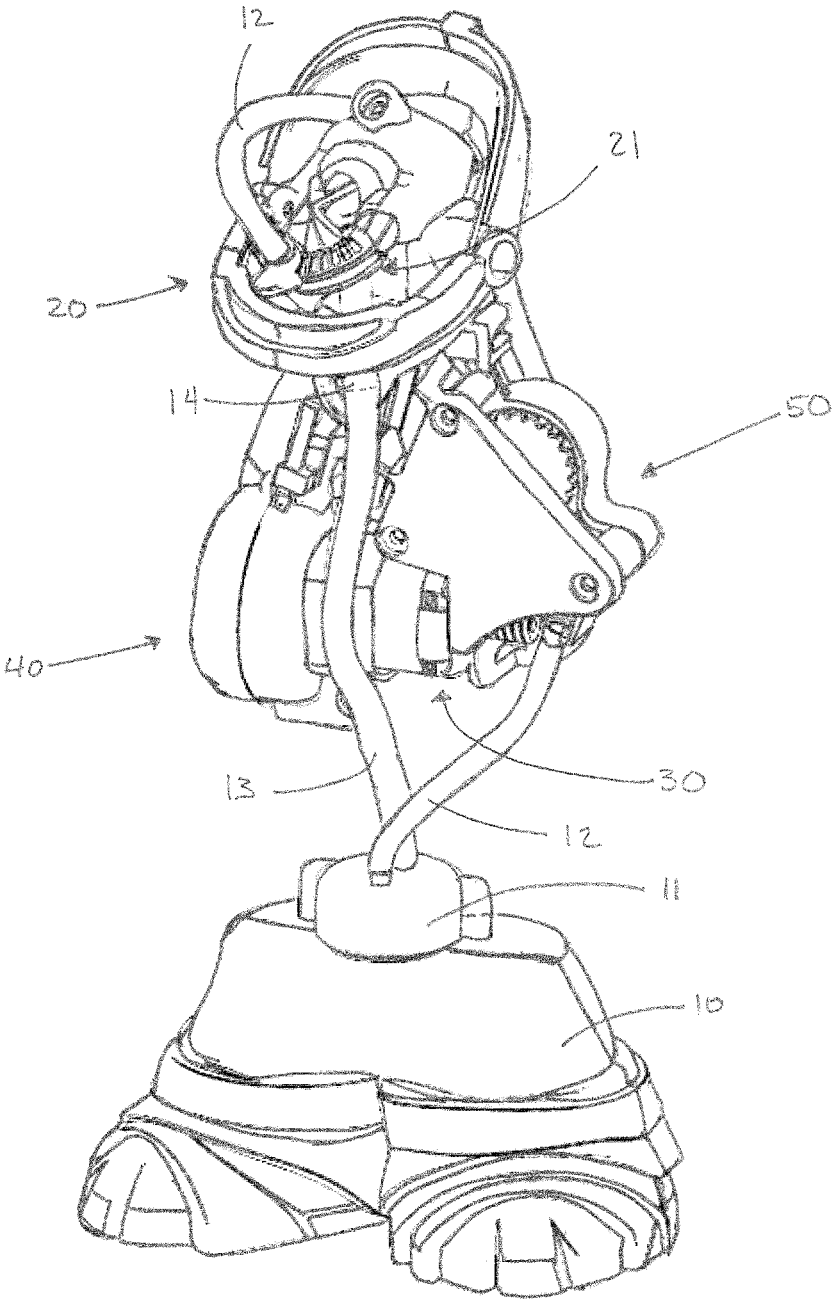
FIG. 1 is a perspective view of an exemplary, motor driven, bubble producing toy in which the invention is embodied. The improved bubble wand mechanism of the invention is shown in its closed position.
Figure 2:
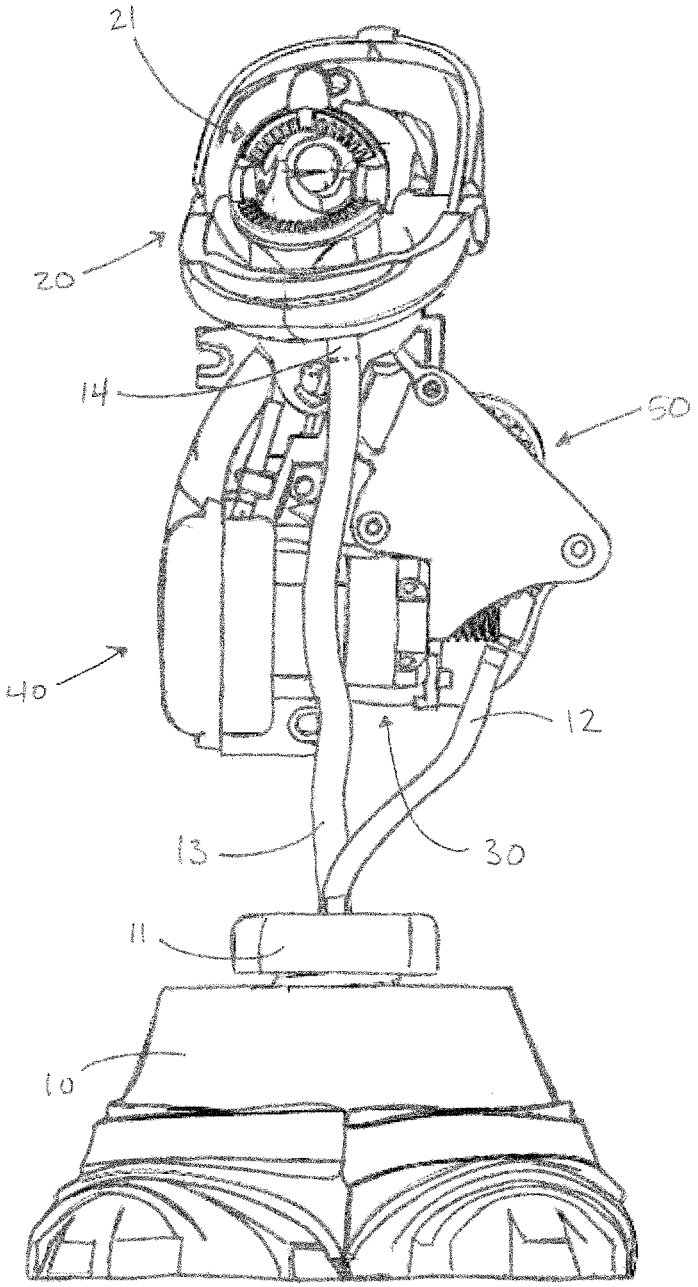
FIG. 2 is front plan view of the toy illustrated in FIG. 1, with the improved bubble wand mechanism of the invention shown in its open, bubble generating, position.

The figures illustrate how the improved bubble wand of the invention can be included in a motor driven bubble producing toy. In FIGS. 1 and 2, there is shown a motor driven bubble producing toy in the general shape of a figurine with a head and a body. The toy is composed of a motor assembly 30, a fan assembly 40, and a pump assembly 50 disposed in the body of the figurine and a bubble making assembly 20 disposed in the head of the figurine. Each of these assemblies will be described in detail infra. The body of the toy has a bubble solution reservoir, 10, for retaining bubble solution and a removable reservoir cap, 19. Removing the cap allows the user to add bubble solution to the reservoir. Connected to the reservoir through cap 11 is a bubble solution feed tube, 12, and a bubble solution return tube, 13. Feed tube 12 extends from the reservoir through the body of the toy and terminates at its other end in a feed tube receptor situated in the bubble making assembly as will be described infra. In FIG. 1, the improved bubble wand mechanism of the invention is illustrated in its closed position and in FIG. 2, it is illustrated in its open, bubble making, position. Bubble solution return tube 13 is also provided, extending from bubble solution outlet 14 (see FIGS. 1 and 4) in the bottom of bubble making assembly 20 into solution reservoir 10 through cap 11. It captures excess bubble solution and returns it to the reservoir.

Figure 3A:
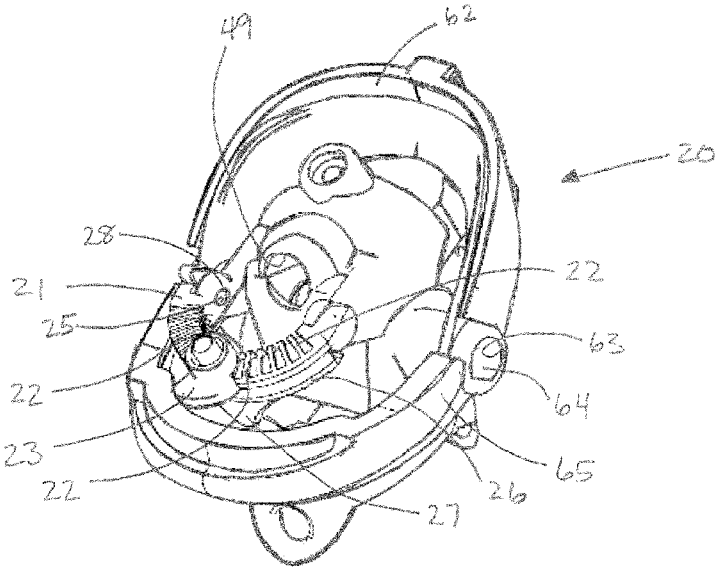
FIGS. 3A and 3B are perspective views of the upper portion of the toy, showing the improved bubble wand in the closed position (FIG. 3A) and the open, bubble generating position (FIG. 3B).
Figure 3B:
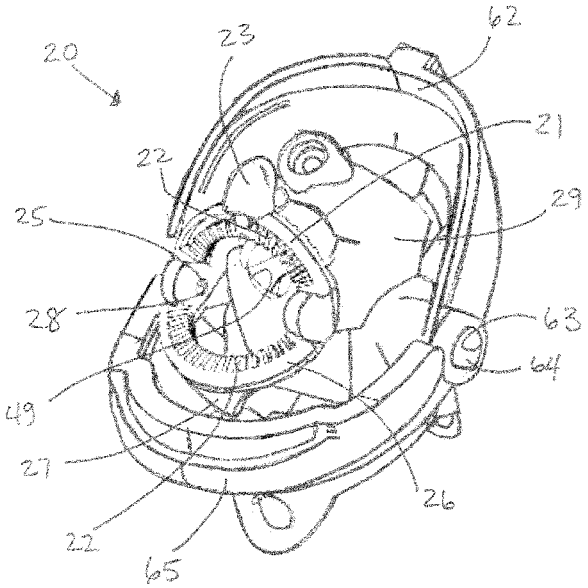
Figure 3C:
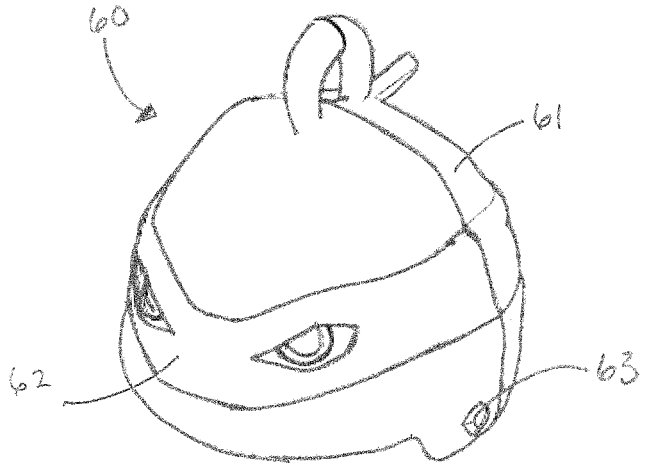
FIG. 3C is a perspective view of the hood portion of the toy.
Figure 4:
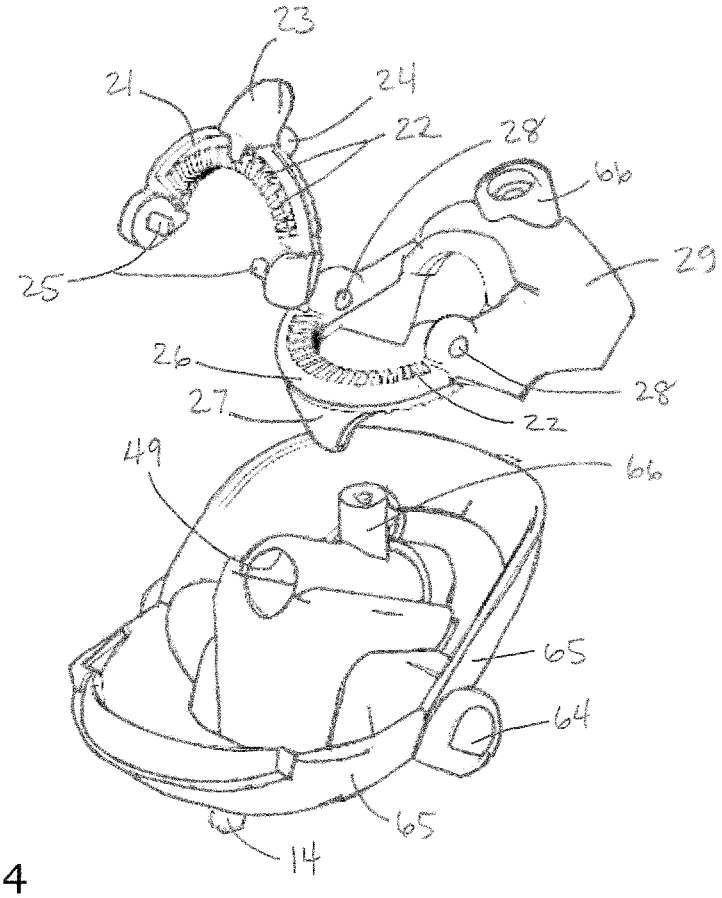
FIG. 4 is an exploded view illustrating the internal components of the motor fan pump assembly and the integrated electrical activation switch of the exemplary toy embodying of the invention.

FIGS. 3 and 4 illustrate the improved bubble want of the invention in detail in its closed position (FIG. 3A), its open position (FIG. 3B), with a hood for a toy figurine with a hooded head embodiment (FIG. 3C), and in an exploded view (FIG. 4). In FIGS. 3A and 3B, moving wand portion 21 and stationary wand portion 26 are formed with regularly spaced apart ribs 22 that assist in film formation by spreading the solution around the wand by capillary action. Moving wand portion 21 and stationary wand portion 26 are demountably fastened to each other by means of an integral hinge composed of a pair of hinge posts 25 at the ends of moving wand portion 21 and a pair mating bores at the ends of stationary wand portion 26. This hinge post and bore arrangement makes for a very simple hinge and enables the bubble wand to open and close in a jaw-like manner. The wand is shown closed in FIG. 3A and open in FIG. 3B. As is typical of bubble wands, the two arcuate wand portions 21 and 26 are substantially planar in aspect, having a width greater than the sides and formed with a series of spaced apart ribs 22 on their front and back surfaces. Also part of the assembly, bubble wand actuator 23 is positioned mid-way between the ends of moving wand portion 21 and projects from the outer side of the arcuate wand portion axially and in the same plane. Actuator 23 is formed with bubble feed tube receptor 24, into which bubble solution feed tube 12 terminates. Receptor 24 is formed with an aperture to permit the solution from the bubble feed tube to enter the receptor and drip onto wand portion 21. Stationary wand portion 26 is stabilized in the head structure 65 of the toy by its connection to wand assembly body 29, which is secured in place by means of screw boss pair 66. The assembly is provided with a manually movable hood, 60, (see FIG. 3C) that is disposed on the head structure 65 and is formed of two pieces, head front 62 and head back 61. Head back 61 is formed with a pair of cam axles 64 and a pair of mated openings 63 in the hood, one on each side thereof. Hood 62 is thereby movable from a closed position covering the bubble producing wand assembly and an open position that exposed the wand assembly to the environment. The front portion of hood 62 is formed so as to engage with actuator 23 when the hood is manually moved to its open position. This engagement moves the moving wand portion from its closed position to it open position and causes spring arm 31 to depress actuating the motor, and thereby the fan and the pump as will be described below.

Figure 5:
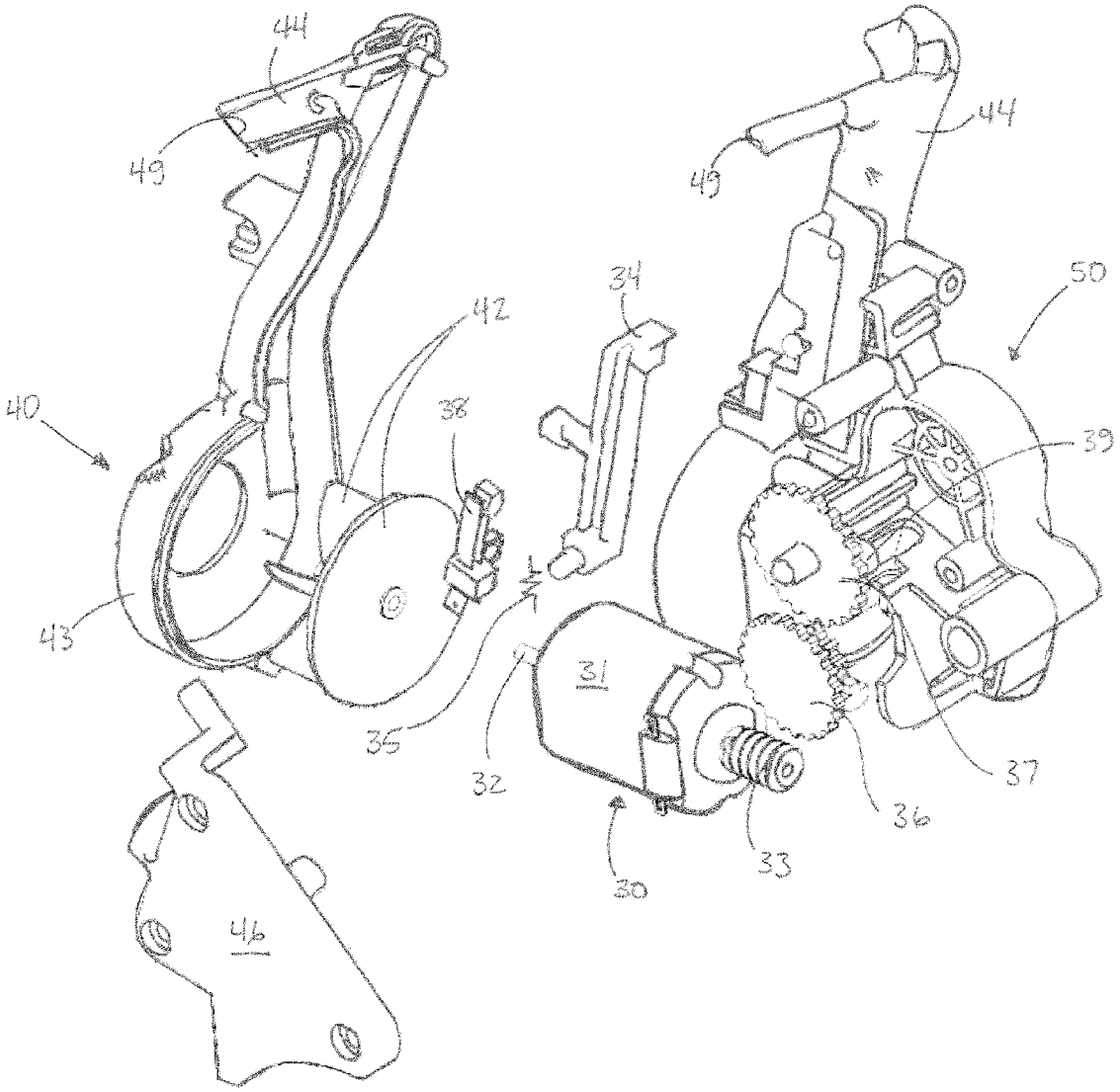
FIG. 5 is an exploded view of the lower portion of the toy showing the arrangement of the motor, fans and actuation assembly.
Figure 6:
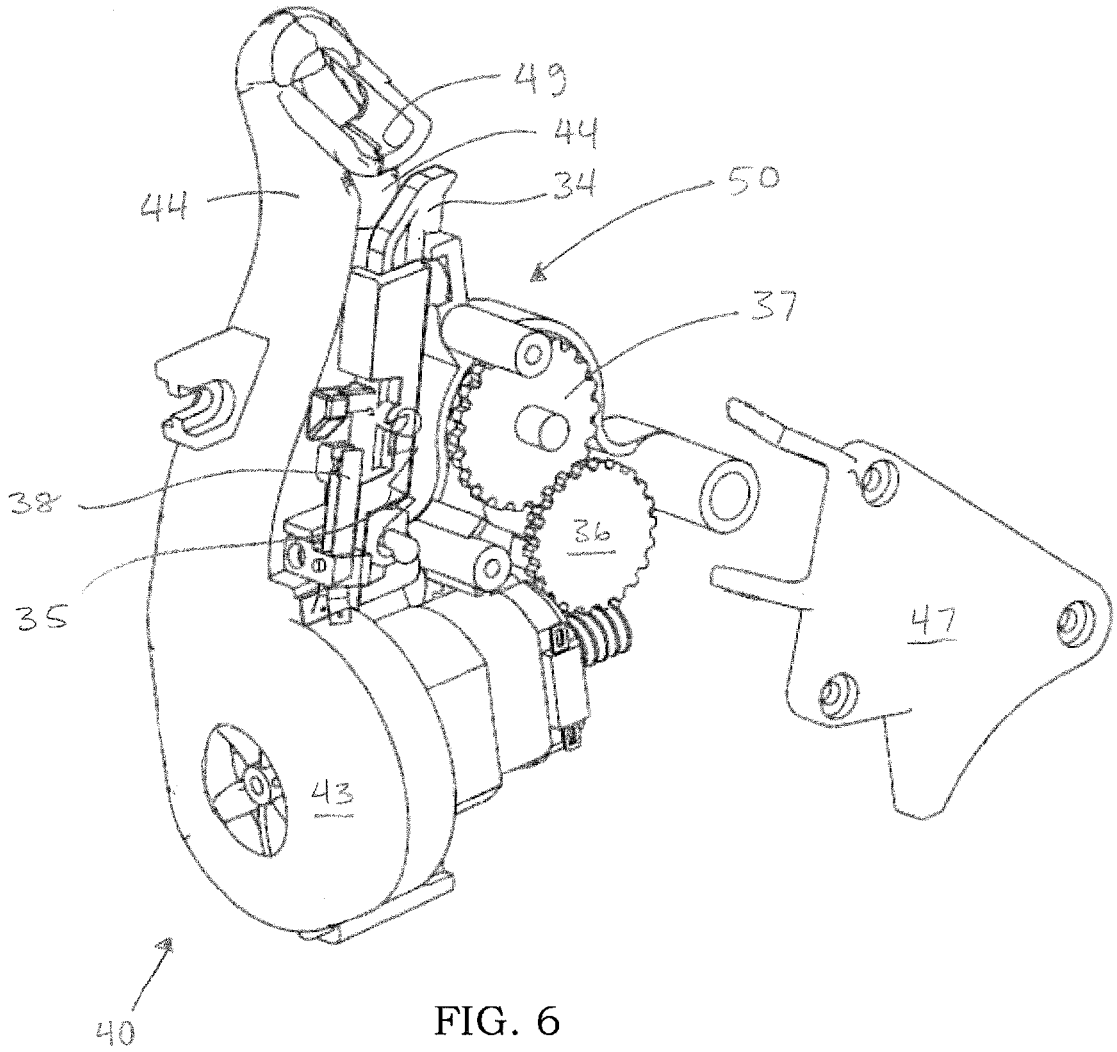
FIG. 6 is a perspective view of FIG. 5.

Referring now to FIGS. 5 and 6, the exemplified motorized bubble producing figurine toy is provided with fan assembly 40 composed of bladed air fan, 42, that is disposed within fan housing 43 and connected to the motor 31 via fan mount 32 as can best be seen in FIG. 5. Motor 31 is provided with pinion gear 33 at its end opposite fan mount 32. Electric switch 38 is connected to motor 31 and to spring arm 34 by means of compression spring 35 (see FIGS. 5 and 6). A pump assembly, 50, including gear 36 and pump roller 37 is provided to pump bubble solution from the reservoir to the wand assembly via feed tube 12. As part of the fan assembly, an air feed tube, 44, which extends from and is formed as part of the fan housing is provided. Air feed tube 44 directs the moving air created by the turning fan blades through the tube and into air aperture 49 disposed and arranged behind the bubble wand assembly in the upper portion of the toy. When electric switch 38 is tripped to start the battery driven motor 21, the motor turns fan 42 forcing air into air aperture 12 and, simultaneously, the motor pinion gear 16 turns pump gear 32 and pump roller 33, which siphons bubble solution from the reservoir through the feed tube, 17, into the bubble solution feed tube receptor and onto the grooved surface of moving wand portion 13.

FIG. 5 shows an exploded view of the fan, pump and motor assemblies of the exemplified toy. Motor 31 is connected to fan 42 and to pump assembly 50 by means of fan mount 32 and pinion gear 33 respectively. Fan 42 is disposed within fan housing 43, which is formed with projecting air feed tube 44 that extends into the bubble making assembly in the head of the figurine, terminating in air aperture 49 behind the bubble wand assembly composed of hingably connected moving and stationary wands 21 and 26. In the motor assembly 30, pinion gear 33 engages with drive gear 36, which in turn engages with pump roller gear 37 in the pump assembly. When motor 31 activated by switch 38, pinion gear 33 turns gear 36, turning pump roller gear 37 causing bubble solution in the reservoir to siphon through bubble feed tube 12 into feed tube receptor 24 and onto moving wand 21 as will be described. Cover plate 47 is provided to protect the pump assembly.

As part of the motor assembly, spring arm 34 is disposed within the body of the figurine between electric switch 38, which is operatively connected to motor 31, and cam axle 64. Cam axle 64 is rotated about an axis when hood 60 is opened. This rotation drives spring arm 34 downward and the bottom of spring arm 34 makes contact with electric switch 38 activating it and the motor thereby. When hood 60 is released, compression spring 35, which is mounted between electric switch 38 and spring arm 34, moves the latter upward and out of contact with the switch, thereby turning off the motor, fan and pump. When the switch is engaged with the swing arm, the motor assembly spins the pinion gear, rotating the drive gear, which in turn rotates the pump roller gear. The pump roller gear is provided with two integral lobes, 39, disposed in opposed relation to each other on the back side of the roller gear. (Only one of the lobes can be seen in FIG. 5.) As the roller gear rotates, the lobes are forced against the bubble solution feed tube 12. This action provides a pulsing pressure, and pumps the solution out of the reservoir into the feed to and out the aperture of the receptor, 24, disposed on the moving wand. Simultaneously, the fan forces air through the projecting air feed tube 44 that extends into the bubble making assembly into the head of the figurine and out air aperture 49 behind the bubble wand assembly. Thus, when hood 62 is opened, bubble wand actuator 23 opens the bubble wand assembly and, simultaneously, the rotation of cam axle 64 engages spring arm 34 to contact switch 38 to turn on the motor, fan and pump to bring air and bubble solution to the wand assembly.

The bubble wand assembly of the invention finds use in any motor driven bubble toy. The foregoing figurine is merely exemplary and should not be limiting. As is known, the hood actuating assembly could readily be replaced with a trigger mechanism actuating opening and closing of the arcuate bubble wand portions, the motor, pump and fan via a series of levers and the figuring replaced with an alternative structure. Also, arrangements of the motor, pump, and fan assemblies different from that describe herein are possible as the skilled artisan will appreciate. All referenced publications are hereby incorporated by reference for the substance of what they disclose.

I claim:

1. In a motor driven, bubble producing toy, the improvement comprising a bubble wand formed with a moving substantially semi-circular, wand portion and a stationary, substantially semi-circular, wand portion, the moving and stationary wand portions having opposed surfaces and wherein the faces and the terminal points are hingably connected to each other at the terminal points of each end of the semi-circular wand portions to permit the moving wand portion to move in opposition to the stationary wand portion from a closed and superposed position over the stationary wand portion to an open, film-forming, position at an angular orientation to the stationary wand portion.

2. The improved bubble wand according to claim 1 wherein the opposed surfaces of the moving and stationary wand portions have a recurring pattern of regularly spaced grooves and ridges that assist in bubble film formation when the moving wand portion is in its open, film-forming, position.

3. The improved bubble wand according to claim 2 that is made of a rigid plastic material.

4. The improved bubble wand according to claim 2 that is made of a rigid plastic material.

5. The improved bubble wand according to claim 4 in which the moving and stationary wand portions are hingably connected to each other by means of a pair of integral posts carried by either the moving or stationary wand portions and a pair of post-receiving bores formed in the other wand portion.

6. The improved bubble wand according to claim 4 in which the moving and stationary wand portions are hingably connected to each other by means of a pair of integral posts carried by either the moving or stationary wand portions and a pair of post-receiving bores formed in the other wand portion.

7. A motor driven, bubble toy comprising a motive power source, a motor, a pump and a supply of forced air driven by the motor, means of engaging the motor to turn it on and off, and a bubble wand assembly mounted in the toy and operatively connected to the pump and the forced air supply, the bubble wand assembly comprising a bubble wand formed with a moving substantially semi-circular, wand portion and a stationary, substantially semi-circular, wand portion, the moving and stationary wand portions having opposed surfaces and terminal points being hingably connected to each other at the terminal points of each end of the semi-circular wand portions to permit the moving wand portion to move in relation to the stationary wand portion from a closed and superposed position over the stationary wand portion when the motor is turned off and to an open, film-forming, position at an angular orientation to the stationary wand portion when the motor is turned on.

8. The improved bubble wand according to claim 1 wherein the opposed surfaces of the moving and stationary wand portions have a recurring pattern of regularly spaced grooves and ridges that assist in bubble film formation when the moving wand portion is in its open, film-forming, position.

* * * * *

UNITED STATES PATENT AND TRADEMARK OFFICE

CERTIFICATE OF CORRECTION

PATENT NO. : 9,266,033 B2
APPLICATION NO. : 14/251852
DATED : February 23, 2016
INVENTOR(S) : John T Davies It is certified that error appears in the above-identified patent and that said Letters Patent is hereby corrected as shown below:

In the Specification:

Col 1, line 30: “an” should be “a”

In the Claims:

Col 5, line 22, claim 3: “2” should be “1”

Signed and Sealed this
Twenty-fourth Day of May, 2016

Michelle K. Lee

Michelle K. Lee
*Director of the United States Patent and Trademark Office*